US008056267B2

(12) United States Patent
Auger et al.

(10) Patent No.: US 8,056,267 B2
(45) Date of Patent: Nov. 15, 2011

(54) ARTICLE OF FOOTWEAR WITH CLEATED SOLE ASSEMBLY

(75) Inventors: Perry W. Auger, Tigard, OR (US); Daniel W. Peter, Portland, OR (US); Sergio Cavaliere, Venice (IT)

(73) Assignee: NIKE, Inc., Beaverton, OR (US)

( * ) Notice: Subject to any disclaimer, the term of this patent is extended or adjusted under 35 U.S.C. 154(b) by 838 days.

(21) Appl. No.: 12/130,097

(22) Filed: May 30, 2008

(65) Prior Publication Data

US 2009/0293315 A1 Dec. 3, 2009

(51) Int. Cl.
*A43B 5/00* (2006.01)

(52) U.S. Cl. ..... 36/114; 36/134; 36/67 R; 36/3 R; 36/3 B

(58) Field of Classification Search ..... 36/114, 36/126–129, 134, 67 R, 67 A, 3 R, 3 B, 30 R
See application file for complete search history.

(56) References Cited

U.S. PATENT DOCUMENTS

| | | | | |
|---|---|---|---|---|
| 911,479 | A | 2/1909 | Doughty et al. | |
| 989,514 | A | 4/1911 | Sanford | |
| 1,141,227 | A | 6/1915 | Bailey | |
| 3,494,055 | A | 2/1970 | McSorley | |
| 3,988,840 | A | 11/1976 | Minihane | |
| 4,014,114 | A | 3/1977 | Jordan et al. | |
| 4,167,071 | A | 9/1979 | Koransky | |
| 4,173,083 | A * | 11/1979 | Infusino | 36/59 R |
| 4,233,759 | A | 11/1980 | Bente et al. | |
| 4,319,412 | A | 3/1982 | Muller et al. | |
| 4,327,503 | A | 5/1982 | Johnson | |
| 4,466,205 | A * | 8/1984 | Corbari | 36/134 |
| 4,524,531 | A | 6/1985 | VanDeripe | |
| 4,698,924 | A * | 10/1987 | Greiner et al. | 36/134 |
| 4,712,318 | A * | 12/1987 | Greiner et al. | 36/134 |
| 4,769,931 | A | 9/1988 | Morrow et al. | |
| 4,833,796 | A * | 5/1989 | Flemming | 36/134 |
| 4,875,683 | A | 10/1989 | Wellman et al. | |
| 5,377,431 | A * | 1/1995 | Walker et al. | 36/134 |
| 5,410,823 | A | 5/1995 | Iyoob | |
| 5,473,827 | A | 12/1995 | Barre et al. | |
| 5,505,012 | A * | 4/1996 | Walker et al. | 36/134 |
| 5,617,653 | A * | 4/1997 | Walker et al. | 36/134 |
| 5,853,844 | A | 12/1998 | Wen | |
| 5,901,472 | A | 5/1999 | Adam | |
| 5,901,473 | A * | 5/1999 | Heifort, IV | 36/134 |

(Continued)

FOREIGN PATENT DOCUMENTS

DE 4417563 A1 11/1995

(Continued)

OTHER PUBLICATIONS

The photograph of "Nike Air Zoom Brasilian MG" shoes that were introduced to the public in Spring, 2006.

(Continued)

*Primary Examiner* — Marie Patterson
(74) *Attorney, Agent, or Firm* — Banner & Witcoff, Ltd.

(57) ABSTRACT

An article of footwear includes an upper and a sole assembly secured to the upper. The sole assembly includes a sole plate having a lower surface, and a plurality of cleats extending downwardly from the lower surface. Each cleat has a central recess formed therein, a core formed of a first material, and an outer layer on the core and formed of a second material that is softer than the first material.

20 Claims, 3 Drawing Sheets

U.S. PATENT DOCUMENTS

| | | | | |
|---|---|---|---|---|
| 5,906,059 | A * | 5/1999 | Singer et al. | 36/134 |
| 5,996,260 | A * | 12/1999 | MacNeill | 36/134 |
| 6,138,386 | A * | 10/2000 | Singer et al. | 36/127 |
| 6,167,641 | B1 | 1/2001 | McMullin | |
| 6,381,878 | B1 * | 5/2002 | Kennedy et al. | 36/134 |
| 6,434,860 | B1 | 8/2002 | Turos | |
| 6,543,160 | B2 | 4/2003 | Price | |
| 6,968,637 | B1 | 11/2005 | Johnson | |
| 7,055,198 | B2 | 6/2006 | Cadamuro et al. | |
| 7,827,705 | B2 * | 11/2010 | Baucom et al. | 36/59 R |
| 2005/0097782 | A1 | 5/2005 | Mills et al. | |
| 2006/0156585 | A1 | 7/2006 | Romero-Sanchez | |
| 2007/0079530 | A1 | 4/2007 | Fusco | |
| 2007/0277399 | A1 * | 12/2007 | Dow et al. | 36/134 |
| 2009/0139112 | A1 * | 6/2009 | Garneau | 36/131 |

FOREIGN PATENT DOCUMENTS

| | | | |
|---|---|---|---|
| WO | 2009117543 | A | 9/2009 |

OTHER PUBLICATIONS

U.S. Appl. No. 11/683,965, filed Mar. 8, 2007, Jim Baucom et al.
U.S. Appl. No. 11/683,967, filed Mar. 8, 2007, Clifford B. Gerber.
International Search Report and Written Opinion of the International Searching Authority issued Oct. 26, 2009 in corresponding PCT Application No. PCT/US2009/044933.

* cited by examiner

ARTICLE OF FOOTWEAR WITH CLEATED SOLE ASSEMBLY

TECHNICAL FIELD

This invention relates generally to footwear, and, in particular, to an article of footwear with a cleated sole assembly.

BACKGROUND

Conventional articles of athletic footwear include two primary elements, an upper and a sole structure. The upper provides a covering for the foot that comfortably receives and securely positions the foot with respect to the sole structure. In addition, the upper may have a configuration that protects the foot and provides ventilation, thereby cooling the foot and removing perspiration. The sole structure is secured to a lower portion of the upper and is generally positioned between the foot and the ground. In addition to attenuating ground reaction forces, the sole structure may provide traction, control foot motions (e.g., by resisting over pronation), and impart stability, for example. Accordingly, the upper and the sole structure operate cooperatively to provide a comfortable structure that is suited for a wide variety of activities, such as walking and running.

The sole structure generally incorporates multiple layers that are conventionally referred to as an insole, a midsole, and an outsole. The insole is a thin, compressible member located within the upper and adjacent to a plantar (i.e., lower) surface of the foot to enhance footwear comfort. The midsole, which is conventionally secured to the upper along the length of the upper, forms a middle layer of the sole structure and is primarily responsible for attenuating ground reaction forces. The outsole forms the ground-contacting element of footwear and is usually fashioned from a durable, wear-resistant material that includes texturing to improve traction.

Certain footwear is provided with cleats in order to provide enhanced traction. Cleated footwear is often used on grass surfaces, and is more frequently being used on artificial surfaces, or "artificial turf" surfaces. Many artificial turf surfaces are harder than conventional grass surfaces, resulting in greater impact forces on the feet of the user. Additionally, artificial turf surfaces may also have higher surface temperatures than conventional grass surfaces.

It would be desirable to provide an article of footwear with a cleated sole assembly that reduces or overcomes some or all of the difficulties inherent in prior known devices. Particular objects and advantages will be apparent to those skilled in the art, that is, those who are knowledgeable or experienced in this field of technology, in view of the following disclosure of the invention and detailed description of certain embodiments.

SUMMARY

The principles disclosed herein may be used to advantage to provide an article of footwear with a cleated sole assembly having improved cushioning, traction, and cooling of the sole assembly. In accordance with a first aspect, an article of footwear includes an upper and a sole assembly secured to the upper. The sole assembly includes a sole plate having a lower surface, and a plurality of cleats extending downwardly from the lower surface. Each cleat has a central recess formed therein, a core formed of a first material, and an outer layer on the core and formed of a second material that is softer than the first material In accordance with another aspect, an article of footwear includes an upper and a sole assembly secured to the upper. The sole assembly includes a sole plate having a lower surface and a plurality of cleats extending downwardly from the lower surface. Each cleat has a central recess formed therein, a core formed of a first material, and an outer layer on the core and formed of a second material that is softer than the first material. A circulation plate is disposed on the lower surface of the sole plate, and extends from a heel portion of the sole plate to a midfoot portion of the sole plate, and defines a circulation cavity between the sole plate and the circulation plate. A first plurality of apertures extends through a front portion of the circulation plate and a second plurality of apertures extends through a rear portion of the circulation plate.

Substantial advantage is achieved by providing an article of footwear with a cleated sole assembly. In particular, certain embodiments provide a user with enhanced cushioning and support, as well as improved cooling of the article of footwear. This is especially advantageous when the footwear is used on artificial turf surfaces, which tend to reach relatively high temperatures.

These and additional features and advantages disclosed here will be further understood from the following detailed disclosure of certain embodiments.

BRIEF DESCRIPTION OF THE DRAWINGS

FIG. 4 is a section view of an alternative embodiment of a portion of the sole assembly of FIG. 1.

Figure 1:
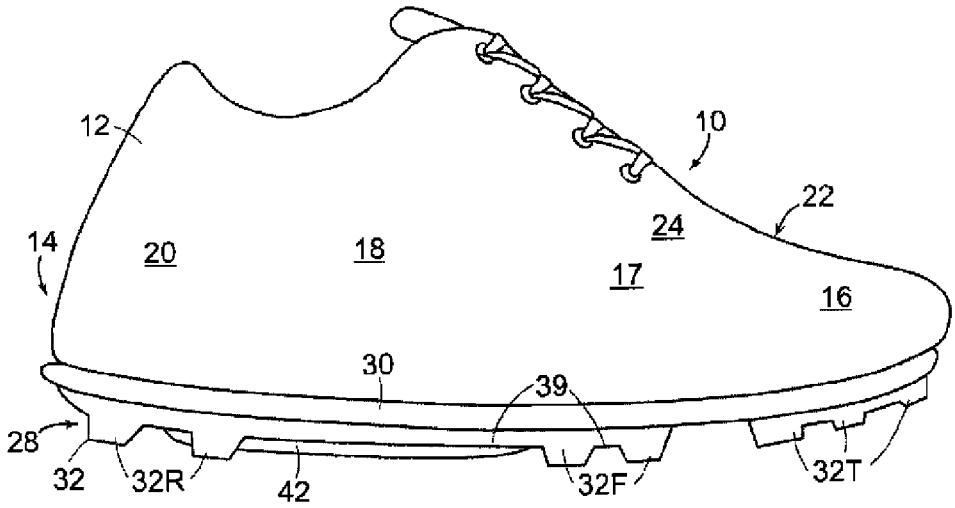
FIG. 1 is an elevation view of an article of footwear with a cleated sole assembly.

The figures referred to above are not drawn necessarily to scale, should be understood to provide a representation of particular embodiments of the invention, and are merely conceptual in nature and illustrative of the principles involved. Some features of the article of footwear with a cleated sole assembly depicted in the drawings have been enlarged or distorted relative to others to facilitate explanation and understanding. The same reference numbers are used in the drawings for similar or identical components and features shown in various alternative embodiments. Articles of footwear with a cleated sole assembly as disclosed herein would have configurations and components determined, in part, by the intended application and environment in which they are used.

DETAILED DESCRIPTION OF CERTAIN PREFERRED EMBODIMENTS

The following discussion and accompanying figures disclose various embodiments of an article of footwear with a cleated sole assembly, which is particularly suited for use on artificial turf surfaces. It is to be appreciated that the article of footwear may also be used on natural turf surfaces.

Figure 2:
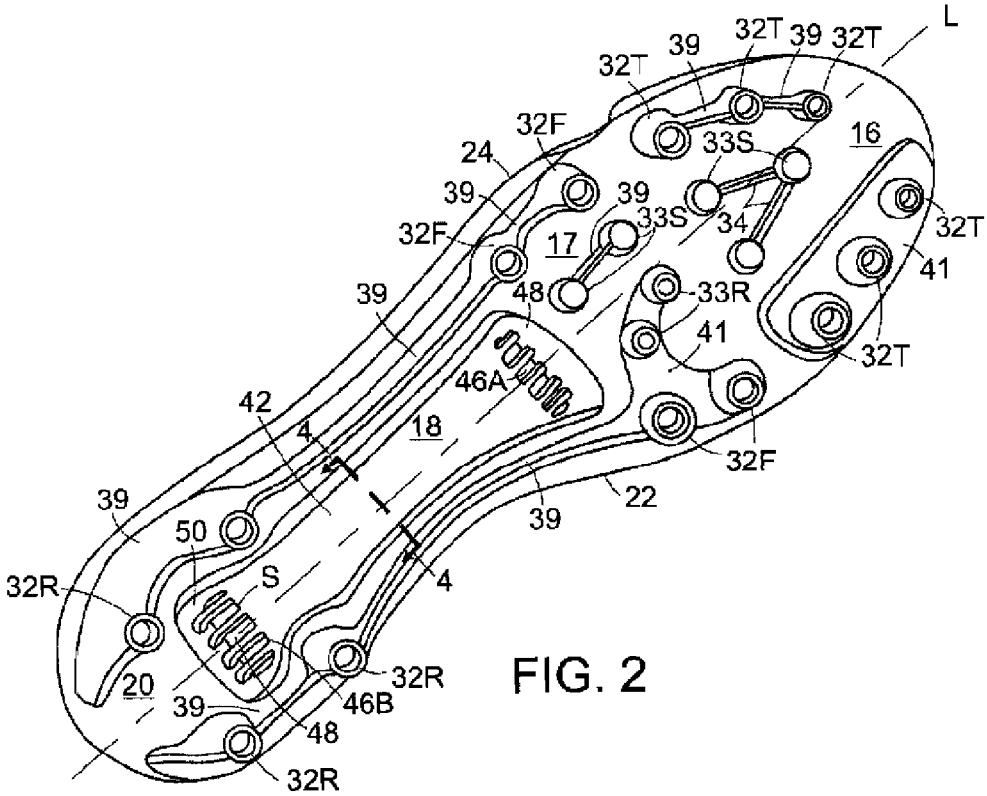
FIG. 2 is a bottom perspective view of the article of footwear of FIG. 1.

An article of footwear 10 is depicted in FIGS. 1-2 as including an upper 12 and a cleated sole assembly 14. For reference purposes, footwear 10 may be divided into three general portions: a toe portion 16, a forefoot portion 17, a midfoot portion 18, and a heel portion 20, as shown in FIGS. 1 and 2. Footwear 10 also includes a lateral side 22 and a medial side 24. Toe portion 16 generally includes portions of footwear 10 corresponding with the toes. Forefoot portion 17 generally includes the joints connecting the metatarsals with the phalanges. Midfoot portion 18 generally includes portions of footwear 10 corresponding with the arch area of the foot, and heel portion 20 corresponds with rear portions of the foot, including the calcaneus bone. Lateral side 22 and medial side 24 extend through each of portions 16-20 and correspond with opposite sides of footwear 10.

Portions 16-20 and sides 22-24 are not intended to demarcate precise areas of footwear 10. Rather, portions 16-20 and sides 22-24 are intended to represent general areas of footwear 10 to aid in the following discussion. In addition to footwear 10, portions 16-20 and sides 22-24 may also be applied to upper 12, sole assembly 14, and individual elements thereof.

The figures illustrate only the article of footwear intended for use on the left foot of a wearer. One skilled in the art will recognize that a right article of footwear, such article being the mirror image of the left, is intended to fall within the scope of the present invention.

Unless otherwise stated, or otherwise clear from the context below, directional terms used herein, such as rearwardly, forwardly, inwardly, downwardly, upwardly, etc., refer to directions relative to footwear 10 itself. Footwear 10 is shown in FIG. 1 to be disposed substantially horizontally, as it would be positioned on a horizontal surface when worn by a wearer. However, it is to be appreciated that footwear 10 need not be limited to such an orientation. Thus, in the illustrated embodiment of FIG. 1, rearwardly is toward heel portion 20, that is, to the left as seen in FIG. 1. Naturally, forwardly is toward toe portion 16, that is, to the right seen in FIG. 1, and downwardly is toward the bottom of the page as seen in FIG. 1. Inwardly is toward the center of footwear 10, and outwardly is toward the outer peripheral edge of footwear 10.

Upper 12 forms an interior void that comfortably receives a foot and secures the position of the foot relative to sole assembly 14. The configuration of upper 12, as depicted, is suitable for use during athletic activities that involve running. Accordingly, upper 12 may have a lightweight, breathable construction that includes multiple layers of leather, textile, polymer, and foam elements adhesively bonded and stitched together. For example, upper 12 may have an exterior that includes leather elements and textile elements for resisting abrasion and providing breathability, respectively. The interior of upper 12 may have foam elements for enhancing the comfort of footwear 10, and the interior surface may include a moisture-wicking textile for removing excess moisture from the area immediately surrounding the foot.

Sole assembly 14 may be secured to upper 12 by an adhesive, or any other suitable fastening means. Sole assembly 14, which is generally disposed between the foot of the wearer and the ground, provides attenuation of ground reaction forces (i.e., imparting cushioning), traction, and may control foot motions, such as pronation. As with conventional articles of footwear, sole assembly 14 includes an insole (not shown) located within upper 12, and an outsole 28. Outsole 28 includes a plurality of cleats, described in detail below.

Figure 7:
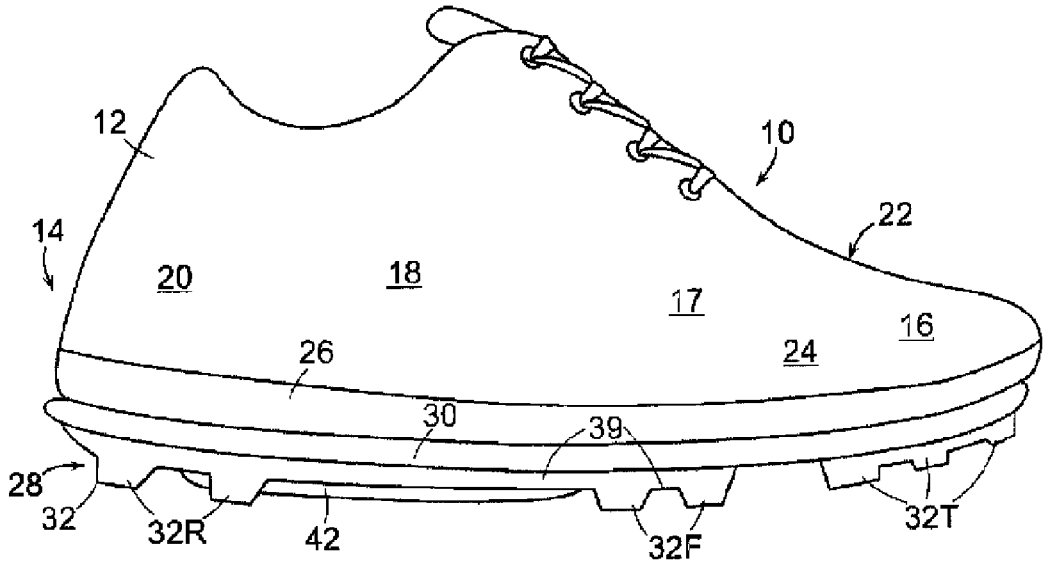
FIG. 7 is an elevation view of an alternative embodiment of an article of footwear with a cleated sole assembly.

In certain embodiments, as seen in FIG. 7, sole assembly may include a midsole 26. Midsole 26 is attached to upper 12 and functions as a shock-attenuating and energy-absorbing component of footwear 10.

Sole assembly 14 includes a sole plate 30 positioned beneath upper 12. In certain embodiments, sole plate 30 is formed of thermoplastic polyurethane (TPU). In other embodiments, sole plate 30 may be formed of a glass-filled nylon material. In still other embodiments, sole plate 30 may be formed of a glass-filled TPU. Other suitable materials for sole plate 30 will become readily apparent to those skilled in the art, given the benefit of this disclosure.

As noted above, outsole 28 includes a plurality of cleats 32 extending downwardly from a lower surface 34 of sole plate 30 and about a periphery of sole plate 30. Each cleat 32 has a central recess 36 formed therein such that cleats 32 are substantially hollow cylindrical members. Cleats 32 have a height H, measured from lower surface 34 to the lowermost portion of cleat 32, and an outer diameter D1. Recess 36 has an inner diameter D2, and a depth R. It is to be appreciated that each of height H, diameters D1 and D2, and depth R are parameters that can be altered to provide desired aesthetic and performance characteristics for footwear 10. For example, these parameters can be adjusted to be optimized for a particular playing surface upon which footwear 10 will be used. Alternatively, these parameters can be altered depending on the particular sport to be played. These parameters can be varied from one article of footwear 10 to another, or they may be varied between different cleats 32 on the same article of footwear. In certain embodiments, two or more cleats 32 and corresponding recesses 36 on article of footwear 10 could have the same height H, diameters D1 and D2, and depth R as one another, while one or more cleats 32 and corresponding recesses 36 could have at least one of height H, diameters D1 and D2, and depth R that are different than that of the two or more cleats 32 and corresponding recesses 36 with the same parameters. It is to be appreciated that any number of similar or different parameters can apply to any of cleats 32 and corresponding recesses 36 on footwear 10.

In certain embodiments, depth R of cleats 32 is approximately 5 mm. As noted above, cleats 32 may have any desired depth. In certain embodiments, diameter D1 is approximately 12.5 mm and diameter D2 is approximately 6.5 mm, such that the wall thickness of cleats 32 is approximately 3.0 mm at its lower surface. It is to be appreciated that diameters D1 and D2 may have any desired value.

In the illustrated embodiment, as seen in FIG. 2, there are four rear cleats 32R positioned in heel portion 20 of sole assembly 14. Two of the rear cleats 32R are positioned on lateral side 22 of sole assembly 14, and the other two rear cleats 32R are positioned on medial side 24. In the illustrated embodiment, rear cleats 32R have a height H of approximately 14 mm.

In the illustrated embodiment, there are four forefoot cleats 32F positioned in forefoot portion 17 of sole assembly 14. Two forefoot cleats 32F are positioned on lateral side 22, and two forefoot cleats 32F are positioned on medial side 24. In certain embodiments, forefoot cleats 32F have a height of approximately 11 mm.

In certain embodiments, a plurality of secondary cleats 33 is provided on sole assembly 14. Secondary cleats 33 are provided inboard of cleats 32. Some secondary cleats 33S are solid and do not include a recess as found in cleats 32. Some secondary cleats 33R include a recess in a lower surface thereof.

In the illustrated embodiment, two forefoot secondary cleats 33S are positioned in a central area of forefoot portion 17, with a rib 39 extending along the lower surface of upper 12 between the secondary cleats 33S. In the illustrated embodiment, the forefoot secondary cleats 33S are positioned forward and rearward of one another such that the rib 39 that extends between them is substantially parallel to longitudinal axis L.

In the illustrated embodiment, a plurality of toe secondary cleats 33S is positioned in a central area of toe portion 16. In the illustrated embodiment, three secondary cleats 33S are positioned in toe portion 16, with two rearmost secondary cleats 33S positioned behind a foremost secondary cleat 33S in a triangular configuration. A rib 39 extends between the foremost secondary cleat 33S and each of the rearmost secondary cleats 33S.

Figure 5:
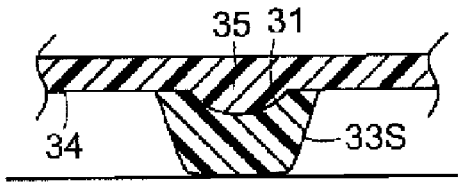
FIG. 5 is a section view of a secondary cleat of the sole assembly of FIG. 1.

As noted above, and more clearly seen in FIG. 5, secondary cleats 33S are solid. In certain embodiments, a recess 31 is formed in an upper surface of each secondary cleat 33S, with a projection 35 on lower surface 34 of sole plate 32 extending into recess 31. In certain embodiments, secondary cleats 33S may have a height of approximately 6.5 mm and an outer diameter at their lowermost surface of approximately 9.0 mm.

Figure 6:
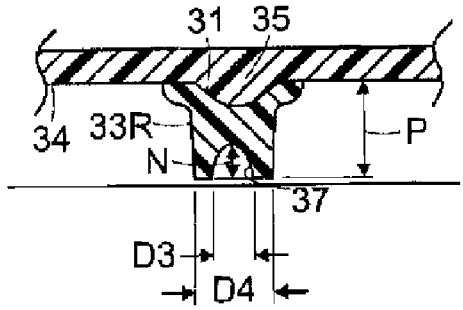
FIG. 6 is a section view of an alternative embodiment of a secondary cleat of the sole assembly of FIG. 1.

Secondary cleats 33R are positioned in midfoot portion 17 inboard of medial forefoot cleats 32F. As noted above, and seen in FIG. 6, secondary cleats 33R include a recess 37 in a lower surface thereof. Secondary cleats 33R have an inner diameter D3 of approximately 4.0 mm and an outer diameter D4 of approximately 8.0 mm such that the wall thickness of secondary cleats 33R at their lower most surface is approximately 2.0 mm. Secondary cleats 33R have a height P of approximately 5.5 mm, and recess 37 has a depth N of approximately 1.0 mm.

In the illustrated embodiment, six toe cleats 32T are positioned in toe portion 16 of sole assembly 14. Three toe cleats 32T are positioned along lateral side 22, while the other three toe cleats 32T are positioned along medial side 24. In certain embodiments, the height H of toe cleats 32T decrease in size along lateral side 22 and medial side 24. For example, in certain embodiments, the rearmost toe cleats 32T have a height H of approximately 9 mm, the central toe cleats 32T have a height H of approximately 8 mm, and the frontmost toe cleats 32T have a height H of approximately 7 mm. Thus, the toe cleats 32T have heights that vary from approximately 7 mm in a foremost portion of toe portion 16 to approximately 9 mm in a rearmost portion of toe portion 16.

Thus, in the embodiment illustrated in FIG. 2, the height H of cleats 32 generally decreases from heel portion 20 to toe portion 16. This provides for greater anchoring for the user's heel, and more flexibility and pivoting capability for the ball and toes of the user's foot.

Figure 3:
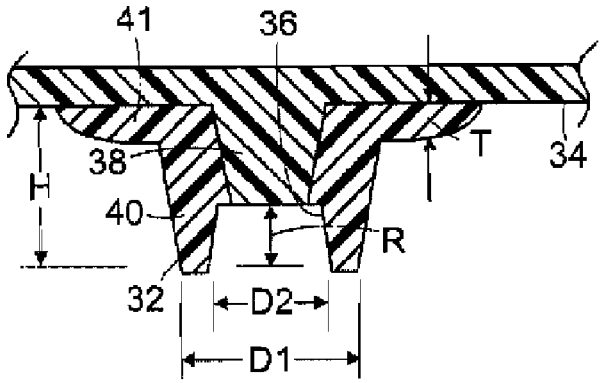
FIG. 3 is a section view of a portion of the sole assembly of FIG. 1.

As seen in FIG. 3, cleats 32 have a core 38 formed of a first material having a first hardness level, and an outer layer 40 positioned on core 38 and formed of a second material having a second hardness level that is lower than the first hardness level, that is softer than the first material. Thus, the second material has a lower hardness value than that of the first material. Providing outer layer 40 of cleats 32 with a softer material can provide enhanced cushioning for the feet of the user, which is especially advantageous when footwear 10 is used on harder surfaces, such as artificial turf surfaces.

Outer layer 40 has a thickness T that varies throughout cleat 32. The thickness of outer layer 40 can be adjusted to provide different performance characteristics for sole assembly 14.

In certain embodiments, core 38 of each cleat 32 is of unitary, that is, one-piece construction with sole plate 30. Thus, core 38 may be formed of TPU, glass-filled nylon, or glass-filled TPU, for example. In certain embodiments, the first hardness level of the first material used to form core 38 may be between approximately 90 A and approximately 98 A. It is to be appreciated that core 38 may be a separate element secured to sole plate 30 with suitable fastening means, such as adhesive, for example.

In certain embodiments, outer layer 40 may be formed of a TPU, for example. Other suitable materials for outer layer 40 will become readily apparent to those skilled in the art, given the benefit of this disclosure. As noted above, outer layer 40 has a hardness level that is lower than that of core 38. In certain embodiments, the second hardness level of the second material used to form outer layer 40 may be between approximately 60 A and approximately 80 A. In certain embodiments, outer layer has a hardness level of approximately 70 A. Outer layer 40 also advantageously provides improved abrasion resistance for footwear 10.

Figure 9:
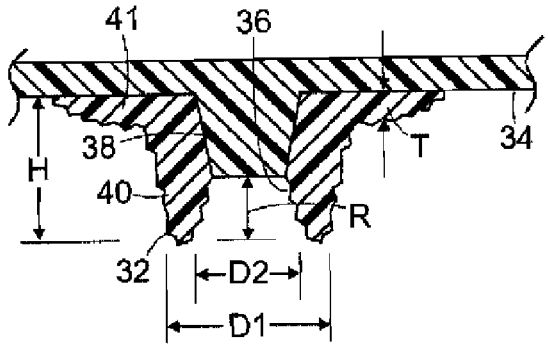
FIG. 9 is a section view of an alternative embodiment of a portion of the sole assembly of FIG. 1.

In the embodiment illustrated in FIG. 3, outer layer 40 has a substantially smooth surface. In certain embodiments, as seen in FIG. 9, outer layer 40 may have a textured outer surface. A non-smooth textured surface can improve traction for footwear 10. It is to be appreciated that certain cleats 32 may have a textured outer surface while other cleats 32 have a non-textured smooth outer surface. It is also to be appreciated that the textured surface can be irregular, or random, while in other embodiments the texture on outer layer 40 may be formed in patter. Thus, for example, a pattern or dimples or ridges could be provided on outer layer 40.

In certain embodiments, one or more ridges or ribs 39 may extend along lower surface 34 of sole plate 30. Ribs 39 extend between a corresponding pair of cleats 32. As illustrated in FIG. 2, ribs 39 extend between the adjacent forefoot cleats 32F on lateral side 24 of toe portion 16. Similarly, a rib 39 extends between the forefoot cleats 32F on lateral side 24. Further, ribs 39 extend between the rearmost midfoot cleat 32F and the foremost rear cleat 32R on both lateral side 24 and medial side 22 of sole assembly 14. Additionally, a rib 39 extends between the rear cleats 32R on both lateral side 24 and medial side 22 of heel portion 20.

In certain embodiments, cleats 32 may include a base portion 41 positioned on lower surface 34. In the embodiment illustrated in FIG. 2, a base portion 41 supports forefoot cleats 32F on medial side 22 of toe portion 16. A base portion 41 also support forefoot cleats 32F on medial side 22 of midfoot portion 18 and extends inwardly beneath forefoot cleats 32R.

Figure 4:
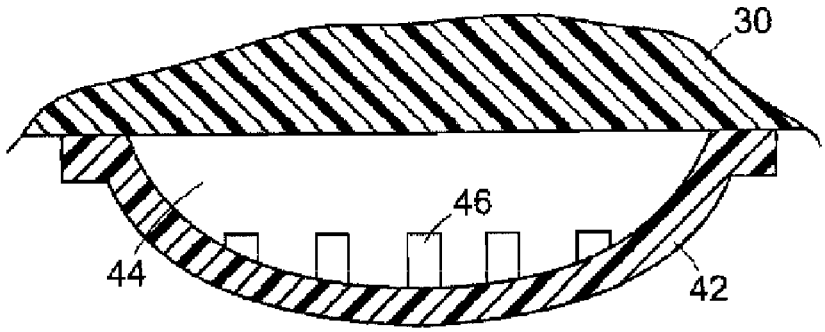
FIG. 4 is a section view of a portion of the sole assembly of FIG. 1, taken along section line 4-4.

In certain embodiments, a circulation plate 42 is provided on lower surface 34 of sole plate 30, as seen in FIGS. 1 and 4. In the illustrated embodiment circulation plate 42 extends from a central portion of heel portion 20 to a rear portion of midfoot portion 18. Circulation plate 42 and sole plate 30 define a circulation cavity 44 therebetween, thereby providing circulation and cooling beneath sole plate 30. In this embodiment, circulation cavity 44 extends between circulation plate 42 and sole plate 30. In the illustrated embodiment circulation plate 42 is curved laterally across a longitudinal axis L of sole plate 30 so as to be convex with respect to sole plate 30. It is to be appreciated that in other embodiments circulation cavity 44 could be partly defined by a recess in lower surface 34 of sole plate 30.

Figure 8:
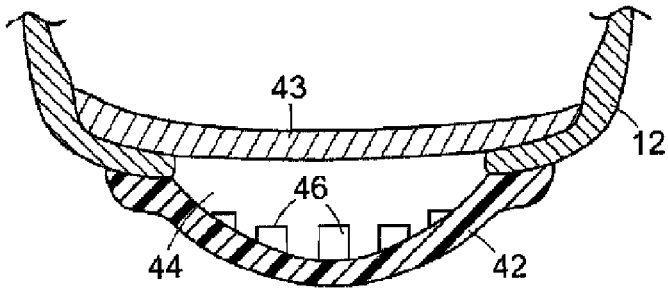
FIG. 8 is

Another embodiment is shown in FIG. 8, in which circulation cavity 44 is positioned below a lasting board/stroebel sock element 43, thereby allowing air to pass into the interior of footwear 10.

In certain embodiments, sole plate 30, cleats 32, and circulation plate 42 are formed by injection molding. In certain embodiments, outer layer 40 of cleats 32 is injected first using the second material, followed by a second injection of the first material on outer layer 40 to form sole plate 30 and core 38.

Finally a third material to form circulation plate 42 is injected onto sole plate 30. It is to be appreciated that, in other embodiments, circulation plate 42 could be secured to sole plate 30 with suitable fastening means such as adhesive. In other embodiments, sole plate 30 and core 38 could be formed before outer layer 40 of cleats 32. Other suitable methods and orders of forming sole plate 30, cleats 32, and circulation plate 42 will become readily apparent to those skilled in the art, given the benefit of this disclosure.

A plurality of apertures 46 is formed in circulation plate 42 to provide for air flow through circulation cavity 44. Allowing air to flow through circulation cavity 44 provides cooling for sole plate 30 and, therefore, all of footwear 10, while sole plate 30 provides a barrier between the user's foot and the exterior of footwear 10. In certain embodiments, a first plurality of apertures 46*a* is formed at a front portion 48 of circulation plate 42, and a second plurality of apertures 46*b* is formed at a rear portion 50 of circulation plate 42. In the illustrated embodiment, each aperture 46 is a substantially longitudinal slot formed in circulation plate 42, with a longitudinal axis S that extends substantially parallel to longitudinal axis L of sole plate 30.

Circulation plate 42 may be formed of a glass-filled nylon or a glass-filled TPU, for example. In addition to providing air circulation and cooling, circulation plate 42 can also provide structure to sole assembly 10, thereby enhancing support for the user's foot.

Thus, while there have been shown, described, and pointed out fundamental novel features of various embodiments, it will be understood that various omissions, substitutions, and changes in the form and details of the devices illustrated, and in their operation, may be made by those skilled in the art without departing from the spirit and scope of the device described herein. For example, it is expressly intended that all combinations of those elements and/or steps which perform substantially the same function, in substantially the same way, to achieve the same results are within the scope of the invention. Substitutions of elements from one described embodiment to another are also fully intended and contemplated. It is the intention, therefore, to be limited only as indicated by the scope of the claims appended hereto.

What is claimed is:

1. An article of footwear comprising:
an upper; and
a sole assembly secured to the upper and comprising:
a sole plate having a lower surface;
a plurality of cleats extending downwardly from the lower surface, each cleat having a central recess formed therein, a core formed of a first material, and an outer layer on the core and formed of a second material that is softer than the first material; and
a circulation plate disposed on the lower surface of the sole plate and defining a circulation cavity between the sole plate and the circulation plate, a first plurality of apertures extending through a front portion of the circulation plate, and a second plurality of apertures extending through a rear portion of the circulation plate.

2. The article of footwear of claim 1, wherein the first material is one of TPU and glass-filled nylon.

3. The article of footwear of claim 1, wherein the second material is TPU.

4. The article of footwear of claim 1, wherein the circulation plate extends from a heel portion of the sole plate to a midfoot portion of the sole plate.

5. The article of footwear of claim 1, wherein each of the first plurality of apertures and the second plurality of apertures comprises a slot having a longitudinal axis that is substantially parallel to a longitudinal axis of the sole plate.

6. The article of footwear of claim 1, wherein the sole plate is formed of one of glass-filled nylon and TPU.

7. The article of footwear of claim 1, wherein the sole plate is formed of a heat blocking material.

8. The article of footwear of claim 1, wherein at least some of the cleats are positioned proximate a peripheral edge of the sole plate.

9. The article of footwear of claim 1, further comprising a first set of cleats in a forefoot portion of having a height ranging from approximately 7 mm in a foremost portion of the forefoot portion to approximately 9 mm in a rearmost portion of the forefoot portion.

10. The article of footwear of claim 9, further comprising a second set of cleats in the forefoot portion of the sole plate and having a height of approximately 11 mm.

11. The article of footwear of claim 10, further comprising a third set of cleats in a heel portion of the sole plate and having a height of approximately 14 mm.

12. The article of footwear of claim 1, wherein the hardness of the first material is between approximately 90 A and approximately 98 A.

13. The article of footwear of claim 1, wherein the hardness of the second material is between approximately 60 A and approximately 80 A.

14. The article of footwear of claim 1, wherein the outer layer of at least one cleat has a textured outer surface.

15. An article of footwear comprising:
an upper; and
a sole assembly secured to the upper and comprising:
a sole plate having a lower surface;
a plurality of cleats extending downwardly from the lower surface, each cleat having a central recess formed therein, a core formed of a first material, and an outer layer on the core and formed of a second material that is softer than the first material; and
a circulation plate disposed on the lower surface of the sole plate, extending from a heel portion of the sole plate to a midfoot portion of the sole plate and defining a circulation cavity between the sole plate and the circulation plate, a first plurality of apertures extending through a front portion of the circulation plate and a second plurality of apertures extending through a rear portion of the circulation plate.

16. The article of footwear of claim 15, further comprising a first set of cleats in a forefoot portion of having a height ranging from approximately 7 mm in a foremost portion of the forefoot portion to approximately 9 mm in a rearmost portion of the forefoot portion.

17. The article of footwear of claim 16, further comprising a second set of cleats in the forefoot portion of the sole plate and having a height of approximately 11 mm.

18. The article of footwear of claim 17, further comprising a third set of cleats in a heel portion of the sole plate and having a height of approximately 14 mm.

19. The article of footwear of claim 15, wherein the hardness of the first material is between approximately 90 A and approximately 98 A.

20. The article of footwear of claim 15, wherein the hardness of the second material is between approximately 60 A and approximately 80 A.

* * * * *